US011543091B1

(12) United States Patent
Lu et al.

(10) Patent No.: US 11,543,091 B1
(45) Date of Patent: Jan. 3, 2023

(54) LED PROJECTION LAMP

(71) Applicant: SHENZHEN QIAOHUA INDUSTRIES LIMITED, Shenzhen (CN)

(72) Inventors: Xianqi Lu, Shenzhen (CN); Qingqing Yuan, Shenzhen (CN)

(73) Assignee: SHENZHEN QIAOHUA INDUSTRIES LIMITED, Shenzhen (CN)

( * ) Notice: Subject to any disclaimer, the term of this patent is extended or adjusted under 35 U.S.C. 154(b) by 0 days.

(21) Appl. No.: 17/715,057

(22) Filed: Apr. 7, 2022

(30) Foreign Application Priority Data

Mar. 7, 2022 (CN) ..... 202220480195.4

(51) Int. Cl.

| | |
|---|---|
| ***F21S 4/28*** | (2016.01) |
| ***F21V 23/00*** | (2015.01) |
| ***F21V 19/02*** | (2006.01) |
| *F21Y 115/10* | (2016.01) |

(52) U.S. Cl.
CPC ..... *F21S 4/28* (2016.01); *F21V 19/02* (2013.01); *F21V 23/003* (2013.01); *F21Y 2115/10* (2016.08)

(58) Field of Classification Search
CPC ..... F21S 4/28; F21V 19/02; F21V 23/003; F21Y 2115/10
See application file for complete search history.

(56) References Cited

U.S. PATENT DOCUMENTS

| | | | | |
|---|---|---|---|---|
| 7,267,444 | B2 * | 9/2007 | Black, Jr. | G03B 21/001 353/70 |
| 7,832,917 | B2 * | 11/2010 | Chien | F21S 10/00 362/641 |
| 2010/0277952 | A1 * | 11/2010 | Chien | F21V 14/003 362/641 |
| 2015/0029708 | A1 * | 1/2015 | Huang | F21V 19/02 362/217.02 |

FOREIGN PATENT DOCUMENTS

| | | | |
|---|---|---|---|
| CN | 211853630 U | * | 11/2020 |
| JP | 2006073244 A | * | 3/2006 |
| KR | 20080093527 A | * | 10/2008 |

OTHER PUBLICATIONS

English translation of Deng CN-211853630-U, published Nov. 2020 (Year: 2020).*
English translation of Park KR-20080093527-A, published Oct. 2008 (Year: 2008).*
English translation of Ishida JP-2006073244 A, published Mar. 2006 (Year: 2006).*

* cited by examiner

*Primary Examiner* — Evan P Dzierzynski

(57) ABSTRACT

An LED projection lamp includes a light-emitting assembly and a main body. The light-emitting assembly at least includes a light source for generating light, and a rotating body disposed on a light path of the light for enabling the light to present a first effect. The main body includes an accommodating cavity for accommodating the light-emitting assembly. The main body includes a lens and a light-transmitting sheet, the lens emits a light having the first effect, and the light-transmitting sheet emits the light. A light-blocking member is disposed on an outer portion of the light-transmitting sheet, a light-transmitting hole is defined on the light-blocking member, and the light-transmitting holes enables the light to present a second effect.

11 Claims, 3 Drawing Sheets

LED PROJECTION LAMP

TECHNICAL FIELD

The present disclosure relates to a technical field of illumination, and in particular to an LED projection lamp.

BACKGROUND

An LED projection lamp is further called a linear LED projection lamp, and because an appearance of the LED projection lamp is in a long strip shape, some people call the LED projection lamp an LED strip lamp.

In recent years, as a new type of lamps, use of the LED projection lamp having an atmosphere effect is increasing, many consumers are attracted and the LED projection lamp has gradually become a new trend in market. The LED projection lamp is a lighting lamp having a decorative effect. A lighting effect of the LED projection lamp improves an overall atmosphere of surrounding environment. However, the existing LED projection lamp is single in lighting effect and cannot generate dynamic light effect.

SUMMARY

In order to solve the above problem, the present disclosure provides an LED projection lamp, so as to solve the problem that the existing LED projection lamp is single in lighting effect and cannot generate dynamic light effect.

In order to achieve the above purpose, the present disclosure provides an LED projection lamp, including: a light-emitting assembly and a main body.

The light-emitting assembly at least includes a light source for generating light, and a rotating body disposed on a light path of the light for enabling the light to exhibit a first effect;

The main body includes an accommodating cavity for accommodating the light-emitting assembly, a lens, and a light-transmitting sheet. The lens emits a light having the first effect, and the light-transmitting sheet emits the light. A light-blocking member is disposed on an outer portion of the light-transmitting sheet. light-transmitting holes are defined on the light-blocking member, and the light-transmitting holes enable the light to present a second effect.

Furthermore, the rotating body includes a concave-convex column body and a motor, and the motor is configured to drive the concave-convex column body to rotate.

Furthermore, the LED projection lamp further includes a mounting bracket to mount the rotating body, and mounting holes are defined on the mounting bracket. The light-emitting assembly includes lamp cups for transmitting the light generated by the light source, and the lamp cups are disposed on the mounting holes.

Furthermore, an opening is defined on an upper end of the main body. A surface shell is disposed on the opening, and the surface shell is integrally connected with the lens through welding and screwing.

Furthermore, the rotating body further includes a left bracket and a right bracket. The concave-convex column body is in a hollow column structure. The left bracket and the right bracket are respectively disposed at two ends of the concave-convex column body. The motor is connected with the left bracket through a respective screw, and the right bracket is connected with the main body through a bearing.

Furthermore, the concave-convex column body is a cylinder or a triangular prism or a quadrangular prism or a hexagonal prism.

Furthermore, the main body is in a cuboid structure. The light-blocking member is a front aluminum plate enclosed on an outer wall of a first part of the main body, and a rear aluminum plate is further enclosed on an outer wall of a second part of the main body.

Furthermore, gaskets are disposed at a bottom of the main body.

Compared with prior arts, the present disclosure provides the LED projection lamp, the light generated by the light source may present a RGBW lighting effect after passing through the rotating body to generate a ripple lighting effect, while part of the light is emitted from the light-transmitting holes of the light-blocking member after passing through the light-transmitting sheet, and the light-transmitting holes may be designed into various shapes as required, which is beneficial for enriching lighting and effects thereof, and is further flexible and convenient to use.

Figure 1:
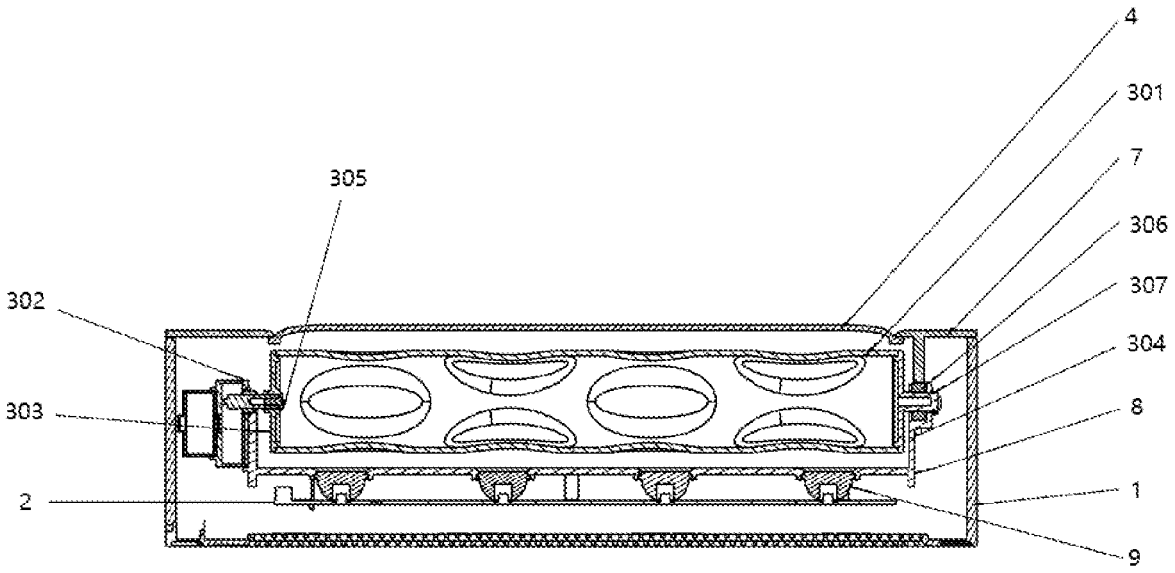
FIG. 1 is a cross-sectional structural schematic diagram of an LED projection lamp of the present disclosure.

Reference number in the drawings: 1. main body; 2. light source; 3. rotating body; 4. lens; 5. light-transmitting sheet; 6. light-blocking member; 7. surface shell; 8. mounting bracket; 9. lamp cups; 10. rear aluminum plate; 11. gasket; 301. concave-convex column body; 302. motor; 303. left bracket; 304. right bracket; 305. screw; 306. bearing; 307. snap spring; and 308. foam cotton 308.

DETAILED DESCRIPTION

The present disclosure is described in details below with reference to accompanying drawings, and technical solutions in embodiments of the present disclosure are clearly and completely described. Obviously, the described embodiments are only a part of the embodiments of the present disclosure, rather than all of the embodiments. Based on the embodiments of the present disclosure, all other embodiments obtained by those of ordinary skill in art without creative work shall fall within a protection scope of the present disclosure.

It should be noted that when a component is referred to as being "fixed to" another component, it may be directly on another component or there may further be an intervening component. When a component is considered to be "connected" to another component, it may be directly connected to another component or there may be a co-existing intervening component. When a component is considered to be "disposed on" another component, it may be directly disposed on another component or there may be a co-existing intervening component. Terms of "vertical", "horizontal", "left", "right", and similar expressions are used herein for illustrative purposes only.

Unless otherwise defined, all technical and scientific terms used herein have a same meaning as commonly understood by those of ordinary skill in the art to which the present disclosure belongs. The terms used herein in the description of the present disclosure are only for the purpose of describing the specific embodiments, and are not intended to limit the present disclosure. As used herein, terms "and/or" include any and all combinations of one or more of the associated listed items.

The technical solutions of the present disclosure are described below through taking an LED line lamp disclosed in the present disclosure as an example.

Referring to FIG. 1-4, the present embodiment provides an LED projection lamp, including a light-emitting assembly. The light-emitting assembly at least includes a light source 2 for generating light, and a rotating body 3 disposed on a light path of the light for enabling the light to present a first effect. The first effect may be one of a RGBW lighting effect and a ripple lighting effect, the present disclosure is not limited hereto, and the present disclosure may further enable the light to present lighting effects of water patterns, fire patterns, starry sky, snowflake patterns, etc.

Figure 2:
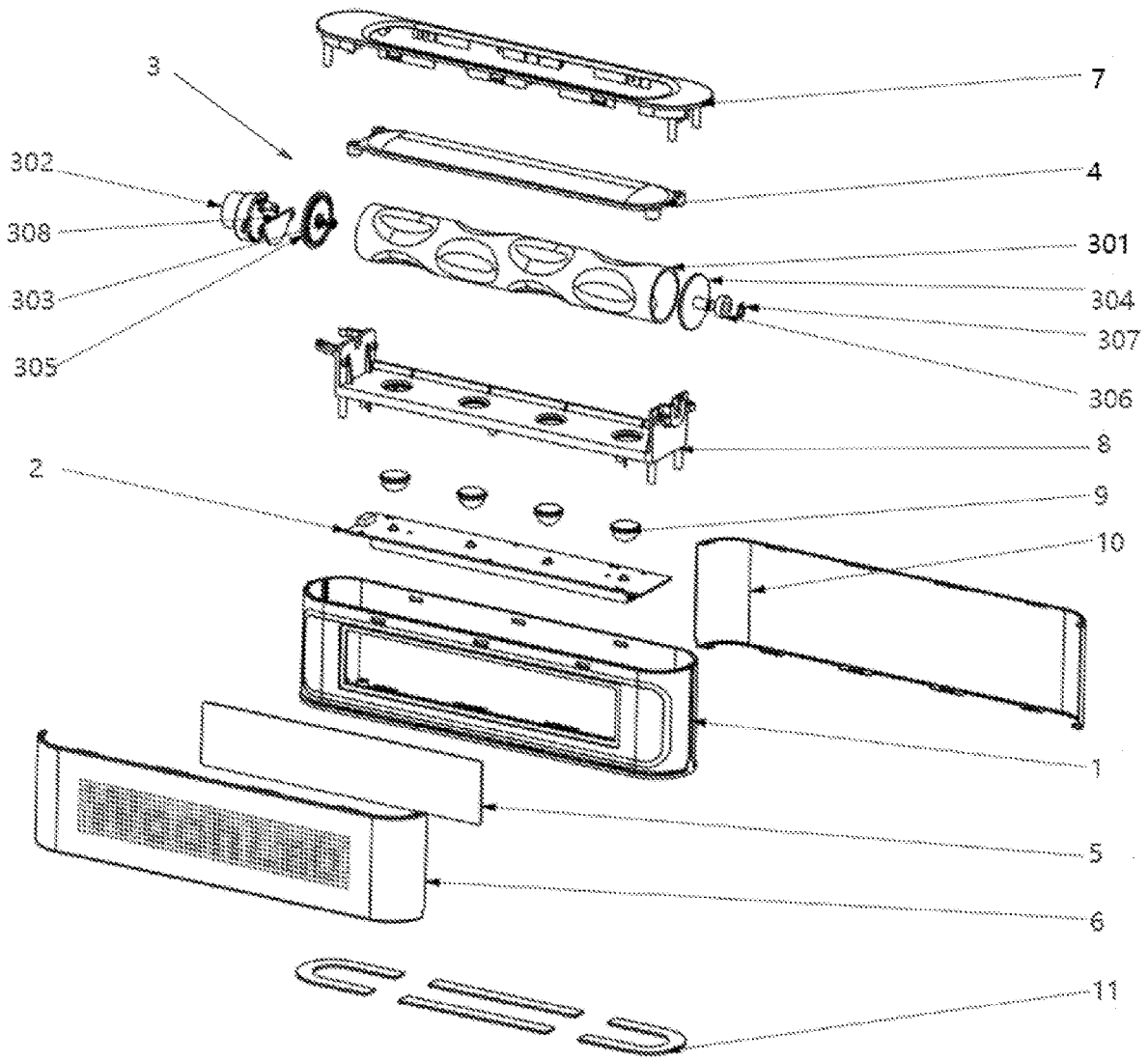
FIG. 2 is an exploded structural schematic diagram of the LED projection lamp of the present disclosure.

FIG. 2 is an exploded structural schematic diagram of the LED projection lamp of the present disclosure. As shown in FIG. 2, the LED projection lamp further includes a main body 1. The main body 1 is generally in a rectangular shape, an opening is defined on an upper end of the main body 1, and the main body includes an accommodating cavity for accommodating the light-emitting assembly. The main body 1 includes a lens 4 for emitting a light having the first effect, and the lens 4 is disposed on the opening on the upper end of the main body 1. A light-transmitting sheet 5 is disposed on a side wall of the main body 1, and the light-transmitting sheet 5 emits the light. A light-blocking member 6 is disposed on an outer portion of the light-transmitting sheet 5, light-transmitting holes are defined on the light-blocking member, and the light-transmitting holes enable the light to present a second effect. In the present embodiment, the second effect may be a typeface or a graphic, and a lighting effect of the second effect is formed by a combination form of the light-transmitting holes. When the light is emitted from the light-transmitting holes, the typeface and the graphic are presented in a highlighted manner.

In addition, the light-blocking member 6 in the embodiment is a front aluminum plate enclosed on an outer wall of a first part of the main body 1, and a rear aluminum plate 10 is further enclosed on an outer wall of a second part of the main body 1. The front aluminum plate and the rear aluminum plate 11 form the side wall of the LED projection lamp, which improves texture of the LED projection lamp and plays a protective role at the same time.

In the embodiment, the rotating body 3 includes a concave-convex column body 301 and a motor 302, and the motor 302 is configured to drive the concave-convex column body 301 to rotate. The light source 2 for generating the light includes a printed circuit board (PCB) and lamp beads. The light emitted by the lamp beads on the PCB is transmitted to the concave-convex column body 301 in a regular or irregular through lamp cups 9. The motor 302 drives the concave-convex column body 301 in the regular or irregular shape to rotate, so as to achieve a dynamic light effect and generate the ripple lighting effect. When two or more colors are emitted by the light source 2, the concave-convex column body 301 in the regular or irregular shape refracts a condensing light to improve the lighting effect. The concave-convex column body 301 in the regular or irregular shape in the above process may be other different columns (such as a cylinder, a triangular prism, a quadrangular prism, a hexagonal prism and other shapes) and surface textures (such as a spiral surface, a concave-convex surface and other textures), so as to achieve different light dynamic effects and light refraction effects.

As shown in FIG. 2, a mounting bracket 8 to mount the rotating body 3 is further disposed in the accommodating cavity, mounting holes are defined on the mounting bracket 8, and the lamp cups 9 are disposed on the mounting holes.

Optionally, the rotating body 3 further includes a left bracket 303 and a right bracket 304. The concave-convex column body 301 is of a hollow column structure, and the left bracket 303 and the right bracket 304 are respectively disposed at two ends of the concave-convex column body 301 through adhesive. The motor 302 is connected to the left bracket 303 through a screw 305. The right bracket 304 is supported by a bearing 306 and is connected to the main body 1, and a snap spring 307 is clamped into a groove of the right bracket 304 to achieve a purpose of limiting, thereby avoiding displacement during rotation.

Figure 3:
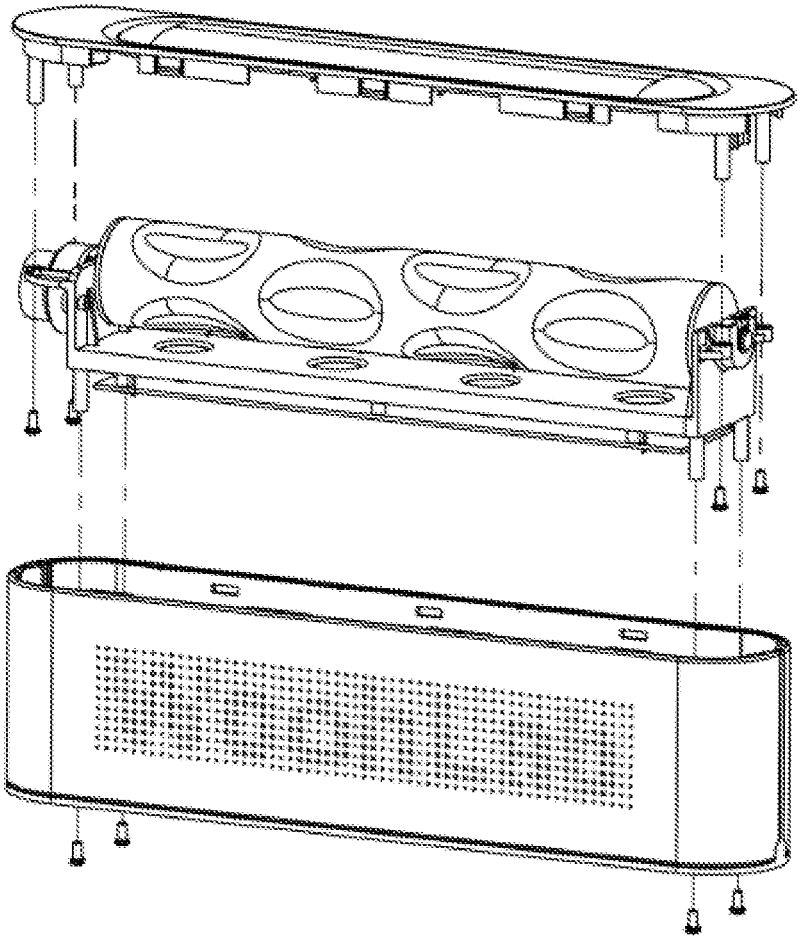
FIG. 3 is a partial exploded structural schematic diagram of the LED projection lamp of the present disclosure.
Figure 4:
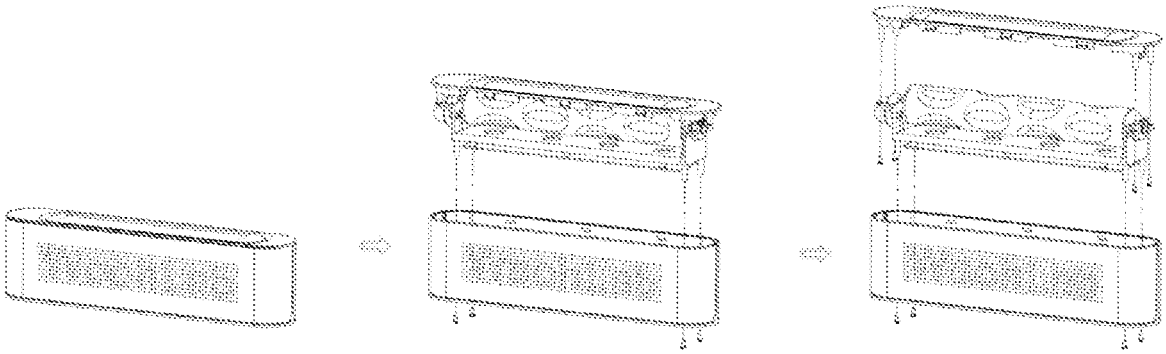
FIG. 4 is an assembly structural schematic diagram of the LED projection lamp of the present disclosure.

Referring to FIG. 3-4, the lens 4 and the surface shell 7 form a surface shell assembly, then the light-emitting assembly is disposed on the surface shell assembly, and then the surface shell assembly is connected with the main body 1 into a whole. The lens 4 is connected with the surface shell 7 through welding and screwing.

Optionally, gaskets 11 are disposed at a bottom of the main body 1 to play an anti-skid role.

Optionally, the rotating body 3 further includes a foam cotton 308, and the foam cotton 308 is disposed between the motor 302 and the left bracket 303.

Through reading and understanding of the above-mentioned specific embodiments, those who skilled in the art may easily implement the present disclosure. However, it should be understood that the present disclosure is not limited to such specific embodiments. On a basis of the disclosed embodiments, those who skilled in the art have been able to arbitrarily combine different technical features to implement different technical solutions, which may further be combined with additional functions in different forms to form other technical solutions. Therefore, the scope of protection of the present disclosure is limited only by the scope of the appended claims.

The present disclosure has been described above with specific examples. The specific examples are merely configured to help understand the present disclosure, and are not intended to limit the present disclosure. For those who skilled in the art, according to an idea of the present disclosure, several simple deductions, deformations or substitutions may further be made.

What is claimed is:

1. An LED projection lamp, comprising:

a light-emitting assembly; and a main body;

wherein the light-emitting assembly at least comprises a light source for generating light, and a rotating body disposed on a light path of the light for enabling the light to present a first effect;

the main body comprises an accommodating cavity for accommodating the light-emitting assembly, a lens, and a light-transmitting sheet; the lens emits a light presenting the first effect, and the light-transmitting sheet emits the light; a light-blocking member is disposed on an outer portion of the light-transmitting sheet; light-transmitting holes are defined on the light-blocking member, and the light-transmitting holes enable the light to present a second effect;

a mounting bracket to mount the rotating body, mounting holes are defined on the mounting bracket; the light-emitting assembly comprises lamp cups for condensing the light generated by the light source, and the lamp cups are disposed on the mounting holes.

2. The LED projection lamp according to claim 1, wherein the rotating body comprises a concave-convex column body and a motor, and the motor is configured to drive the concave-convex column body to rotate.

3. The LED projection lamp according to claim 2, wherein the rotating body further comprises a left bracket and a right bracket, the concave-convex column body is in a hollow column structure, the left bracket and the right bracket are respectively disposed at two ends of the concave-convex column body; the motor is connected with the left bracket through a respective screw; and the right bracket is connected with the main body through a bearing.

4. The LED projection lamp according to claim 3, wherein the concave-convex column body is a cylinder or a triangular prism or a quadrangular prism or a hexagonal prism.

5. The LED projection lamp according to claim 2, wherein the concave-convex column body is a cylinder or a triangular prism or a quadrangular prism or a hexagonal prism.

6. The LED projection lamp according to claim 1, wherein an opening is defined on an upper end of the main body; a surface shell is disposed on the opening, and the surface shell is integrally connected with the lens through welding and screwing.

7. The LED projection lamp according to claim 1, wherein the main body is in a cuboid structure, the light-blocking member is a front aluminum plate enclosed on an outer wall of a first part of the main body, and a rear aluminum plate is further enclosed on an outer wall of a second part of the main body.

8. The LED projection lamp according to claim 1, wherein gaskets are disposed at a bottom of the main body.

9. An LED projection lamp, comprising:

a light-emitting assembly; and a main body;

wherein the light-emitting assembly at least comprises a light source for generating light, and a rotating body disposed on a light path of the light for enabling the light to present a first effect;

the main body comprises an accommodating cavity for accommodating the light-emitting assembly, a lens, and a light-transmitting sheet; the lens emits a light presenting the first effect, and the light-transmitting sheet emits the light; a light-blocking member is disposed on an outer portion of the light-transmitting sheet; light-transmitting holes are defined on the light-blocking member, and the light-transmitting holes enable the light to present a second effect;

wherein an opening is defined on an upper end of the main body; a surface shell is disposed on the opening, and the surface shell is integrally connected with the lens through welding and screwing.

10. The LED projection lamp according to claim 9, wherein the rotating body comprises a concave-convex column body and a motor, and the motor is configured to drive the concave-convex column body to rotate.

11. The LED projection lamp according to claim 9, wherein an opening is defined on an upper end of the main body; a surface shell is disposed on the opening, and the surface shell is integrally connected with the lens through welding and screwing.

* * * * *